United States Patent [19]

Hoefken et al.

[11] Patent Number: 4,831,988

[45] Date of Patent: May 23, 1989

[54] FUEL INJECTION PUMP

[75] Inventors: Wilfried Hoefken, Vaihingen; Wolfgang Scheibe, Ludwigsburg-Poppenweiler, both of Fed. Rep. of Germany

[73] Assignee: Firma L'Orange GmbH, Stuttgart, Fed. Rep. of Germany

[21] Appl. No.: 99,617

[22] Filed: Sep. 22, 1987

[30] Foreign Application Priority Data

Sep. 23, 1986 [DE] Fed. Rep. of Germany ..... 3632299

[51] Int. Cl.[4] ..... F02M 39/00

[52] U.S. Cl. ..... 123/501; 123/458; 123/506

[58] Field of Search ..... 123/501, 500, 506, 458, 123/503

[56] References Cited

U.S. PATENT DOCUMENTS

| | | | |
|---|---|---|---|
| 2,810,375 | 10/1957 | Froehlich | 123/500 |
| 4,378,775 | 4/1983 | Straubel | 123/501 |
| 4,395,987 | 8/1983 | Rodayashi | 123/503 |
| 4,459,963 | 7/1984 | Gross | 123/501 |
| 4,655,183 | 4/1987 | Taira | 123/503 |

FOREIGN PATENT DOCUMENTS

| | | | |
|---|---|---|---|
| 1903619 | 11/1960 | Fed. Rep. of Germany . | |
| 1176422 | 8/1964 | Fed. Rep. of Germany . | |
| 1917927 | 10/1970 | Fed. Rep. of Germany . | |
| 2306007 | 9/1973 | Fed. Rep. of Germany . | |
| 2430668 | 1/1976 | Fed. Rep. of Germany . | |
| 3248086 | 7/1984 | Fed. Rep. of Germany . | |
| 222925 | 12/1983 | Japan | 123/500 |
| 2165894 | 4/1986 | United Kingdom | 123/501 |

*Primary Examiner*—Carl S. Miller

*Attorney, Agent, or Firm*—Barnes & Thornburg

[57] ABSTRACT

A fuel injection pump having a switchable valve for the control of the start of the injection connected to the bore for the piston by a control valve bore provided axially below the filling and control bore. The control valve bore is connected with a pump pressure space via a central bore of the piston and a ring groove in an area removed from the high stress pump pressure space.

8 Claims, 3 Drawing Sheets

FUEL INJECTION PUMP

BACKGROUND AND SUMMARY OF THE INVENTION

The present invention relates to improvements in a fuel injection pump of the style shown in DE-AS 1,093,619, DE-AS 1,176,422; DE-AS 1,917,927; and, DE-AS 2,306,007.

Fuel pumps of this type are generally used to carry out the following objectives:

(a) Reduction of the fuel consumption of the internal-combustion engine, for example, of a diesel engine of a vehicle, particularly by a more precise fuel metering compared with a carburetor engine;

(b) Making the combustion in the internal-combustion engine more complete and thus having the engine generate less harmful substances and making it more friendly with respect to the environment;

(c) Making the fuel metering well controllable over wide operating ranges, but being able to require a construction of the pump that is as simple as possible.

These partly opposing requirements cannot all be met completely at the same time. By a skillful selection of parameters during the designing, a compromise must be found that approaches an optimum.

In the injection pump according to DE-OS 32 48 086, a precise control of the start of the injection is achieved between two limit values fixed by constructional limits by a switchable valve. This arrangement ensures an emergency operating capability even if the valve is no longer operable.

It is a disadvantage in the case of this arrangement that a valve-controlled discharge bore is arranged opposite the inflow bore axially in the direction to the upper dead center. Because of the high pressures of up to 1,500 bar, this bore represents a weakening of the wall strength in the most highly stressed part of the piston guide. In addition, the distance of both bores must be fixed within certain limits in order to ensure an optimal operation and not to excessively stress the valve disk. As a result, the shape and the measurements of the whole injection pump are fixed, and the valve arrangement is fairly large.

It is the objective of the invention to provide an improved injection pump of this type having, in addition to less intallation and space requirements, a valve bore that has more space in axial as well as in circumferential direction, therefore avoiding a weakening of the piston guide.

According to the invention, this objective is achieved by providing the control valve bore which connects the bore in which the cylinder travels with the control valve at an axial position below the filling and control bore. The control valve bore is connected with the pump pressure space above the piston by central and radial bore and a ring groove. The closing of the control valve determines the beginning of the axial position of the piston at which injection begins between a earliest possible axial position defined when the piston covers the filling and control bore and a latest possible position when the central and radial bore and the ring groove are disconnected from the control valve bore. The control valve is an electromagnetic valve which is normal biased closed by a spring.

The most important advantages of the invention is that the arrangement of the valve-controlled discharge bore can be provided at the circumference of the piston guide in a spacious way. The discharge bore is therefore embedded in less highly stressed parts of the piston guide wall and not in the high stress pressure space. The start of the fuel injection can be controlled well by the valve that blocks or exposes the discharge bore. The control valve discharge bore is connected with the pump pressure space via the central piston bore, in which case its length may be selected almost arbitrarily. As a result the distance of the valve and its housing from the high-pressure portion of the injection pump, the seals for the valve housing to the pump housing are also further away from the high pressure seals. Thus desired installing requirements can be taken into account within a wide range.

DE-OS 2,430,668 shows a piston for an injection pump that has a surrounding ring groove connected with the front side of the piston via a central bore. However, in this case, only one single inflow and discharge bore that is arranged in the housing wall can be controlled.

The controllable valve is preferably developed as an electromagnetic valve. Thus a simple electric control can be achieved. In addition, the valve is preferably a normally closed valve spring, changeable from its position that blocks the fuel discharge. Thus, extremely short closing times can be achieved. Only these short valve closing times permit a continuous change of the start of the injection while the pump piston moves between the upper edge of the inflow or filling and control bore and the upper edge of the discharge or control valve bore. The control edges of the piston are generally selected such that the piston reaches the control valve bore or covers its partially when, in the case of the latest possible start of the injection, the valve body is shifted in the working position. The supplying of the fuel takes place irrespectively of whether the control valve is opened or closed, as soon as the bore is closed completely.

Other objects, advantages and novel features of the present invention will become apparent from the following detailed description of the invention when considered in conjunction with the accompanying drawings.

DETAILED DESCRIPTION OF THE DRAWINGS

Figure 1:
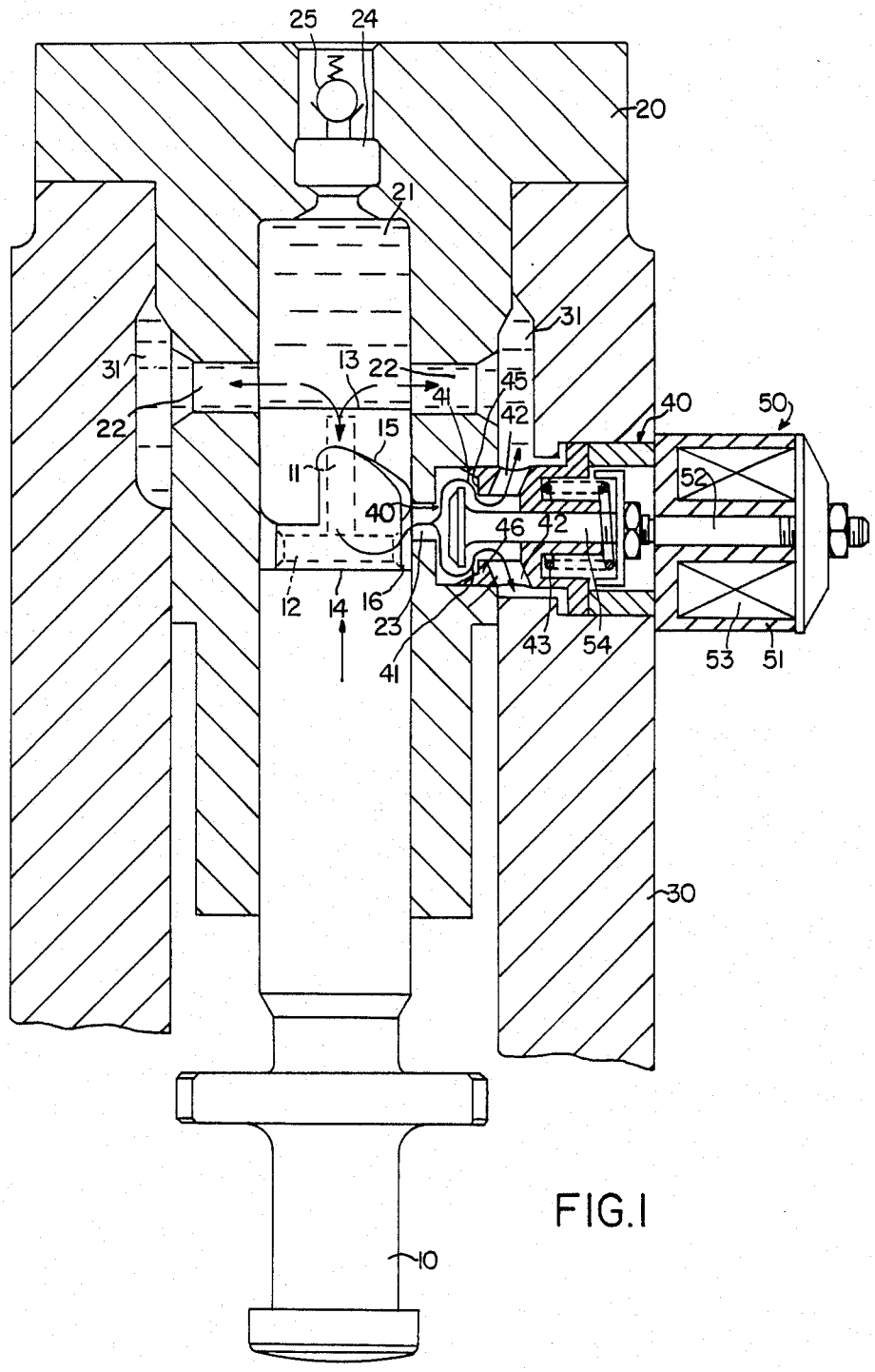
FIG. 1 is a cross sectional view of a pump, according to the present invention, shortly after the start of its upward motion (injection direction) with the filling and control bore and the control valve bore open and the control valve in the open position.

In the position of FIG. 1, the piston 10 has just left the lower dead center and is moving upward and in the process displaces the fuel liquid which is located in the pump pressure space 21.

For the discharge of the fuel liquid displaced by the piston 10, several openings are available. Filling and control bores 22 connect the pump pressure space to the suction space 31 which is further connected to fuel supply lines that are not shown.

In addition, the fuel can flow off through a central bore 11 of the piston 10, cross bore 12 and a ring groove 16 in the direction of the control valve bore 23 through the opened control valve cross-section 41 and the valve outlet openings 42 out into the suction space 31. In the suction space 31, the delivery pressure is relatively low.

The fuel could also flow off via the injection valve bore 24 and through the diagrammatically shown injection valve 25 into the fuel pressure line that is not shown, when the standing pressure existing above the injection valve 25 has been exceeded. This steady pressure is much higher than the pressure in the pump space that remains relatively low as long as sufficiently large discharge openings exist to the suction space 31. A discharge of the fuel through the injection valve bore 24 is not possible in the position of FIG. 1.

Figure 2:
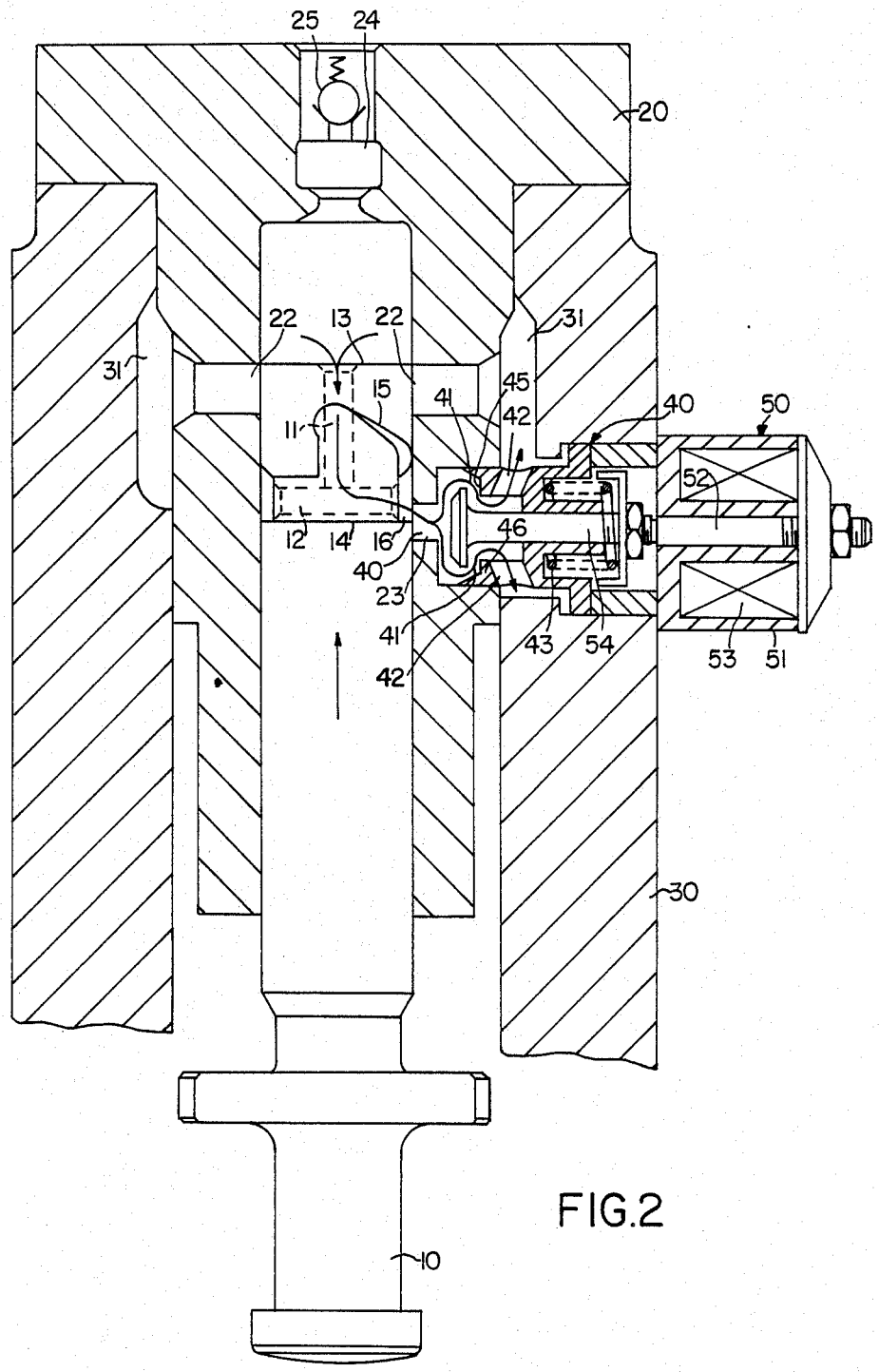
FIG. 2 is a cross sectional view of the continuation of the upward motion of the piston pump with the closing of the filling and control bore and diminishing the opening of the control valve bore and the control valve in the open position.

In the position of FIG. 2, the piston 10 has moved upward and has just closed the filling and control bores 22 by the front-side control edge 13. It is shown that the fuel that is displaced by the piston 10 can continue to escape through the control valve bore 23 and the control valve 40 into the suction space 31, so that no delivery can take place through the injection valve 25 into the fuel pressure line.

Figure 3:
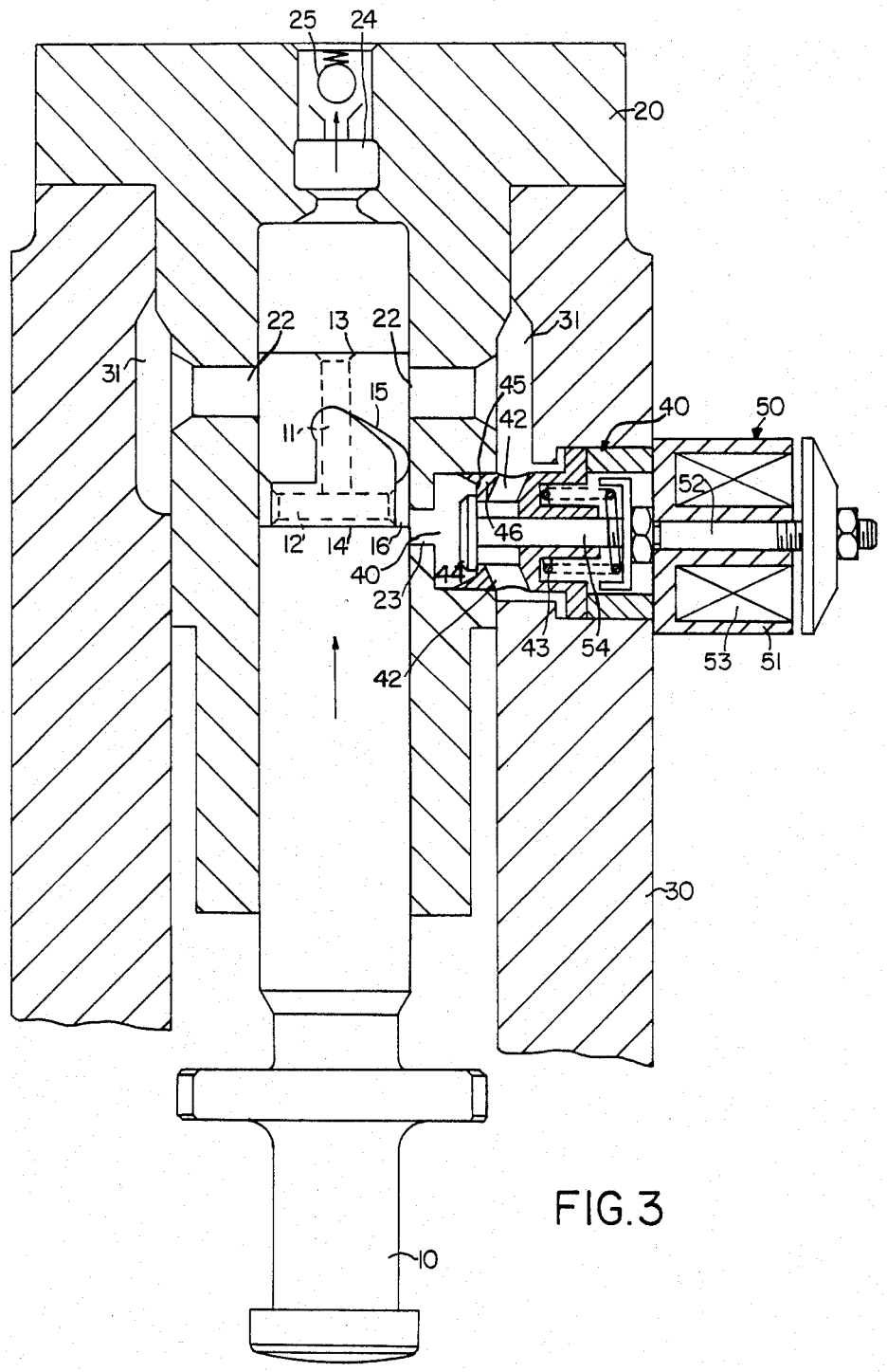
FIG. 3 is a cross sectional view of a position of the piston with the minimal opening of the control valve bore and the control valve in the closed position.

In FIG. 3, the piston has continued its upward movement and has not completely closed the control valve bore 23 so that it depends on the closing condition of the control valve 40 whether a delivery takes place into the fuel pressure line or not through injection valve 25.

In this position, the electromagnetic stator 51 has released the rotor 52 because current no longer flows in the coil 53. The force of the valve spring 43 and/or the pressure force as the fuel liquid on the valve mushroom 44, shift the valve mushroom 44, the rotor pressure bolt 54 and the tierod 52 to the right until the valve mushroom 44 engages the seat 45 of the basic valve body 46. This closes the discharge opening through the valve cross-section 41 and the discharge through the control valve bore 23 in the direction of the suction space 31 is no longer possible.

The actual injection process starts through the pressure valve bore 24 and open injection valve 25 when the piston 10, during its upward-directed pump movement, with its front-side control edge 13, has completely closed the filling and control bores 22, and at the same time, the discharge of fuel from the pump space via the central bore 11 of the piston, beyond the ring groove 16, to the control valve bore 23 is no longer possible because either the control valve 40 blocks the discharge from the control valve bore 23, or the control edge 14 already covers the control valve bore 23 and thus the discharge from it is blocked. However, if the piston was moved further upward to such an extent that the delivery end control edge 15 again exposes the filling and control bores 22 and the fuel can leave them again via the central bore 11 of the piston and the cross-bore 12 of the piston and/or a groove 16 extending on the outside of the piston, the injection process is finished.

If damage occurs at the valve 40 or at its electronic control, a delivery in the fuel pressure line will take place nevertheless since the valve mushroom 44 engages seat 45. But the point in time of the delivery can no longer be selected optimally by the electromagnetic valve, but emergency operating characteristics exist in any case.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A fuel injection pump for an internal-combustion engine comprising:

a piston movable axially in a cylindrical bore of said pump between an upper and lower dead center;

a pressure space in said cylindrical bore between said piston and an injection port;

filling and control bore connecting said pressure space and a fuel supply at a first axial position of said cylindrical bore;

control valve bore connecting said cylindrical bore and a control valve at a second axial position of said cylindrical bore closer to said lower dead center than said first axial piston;

a piston bore including a central axial bore and a radial bore in series for connecting said pressure space and said control valve bore through said piston at various axial positions of said piston;

said piston having a configuration to define an earliest and latest possible axial position of said piston at which injection will begin and said latest possible axial position is independent of said control valve; and means for controlling said control valve to select the axial position of said piston at which injection begins between said earliest and latest possible axial position of said piston.

2. A fuel injection pump for an internal-combustion engine comprising:

a piston movable axially in a cylindrical bore of said pump between an upper and lower dead center;

a pressure space in said cylindrical bore between said piston and an injection port;

filling and control bore connecting said pressure space and a fuel supply at a first axial position of said cylindrical bore;

control valve bore connecting said cylindrical bore and a control valve at a second axial position of said cylindrical bore closer to said lower dead center than said first axial position;

a piston bore connecting said pressure space and said control valve bore through said piston at various axial positions of said piston;

said piston having a configuration to define an earliest and latest possible axial position of said piston at which injection will begin and said latest possible axial position is independent of said control valve;

said earliest possible axial position of said piston at which injection begins being a third axial position at which said piston covers said filling and control bore and said latest possible axial position of said piston at which injection begins being a fourth axial position at which said piston bore is disconnected from said control valve bore; and means for controlling said control valve to select the axial position of said piston at which injection begins between said earliest and latest possible axial position of said piston.

3. A fuel injection pump for an internal-combustion engine comprising:

a piston movable axially in a cylindrical bore of said pump between an upper and lower dead center;

a pressure space in said cylindrical bore between said piston and an injection port;

filling and control bore connecting said pressure space and a fuel supply at a first axial position of said cylindrical bore;

control valve bore connecting said cylindrical bore and a control valve at a second axial position of said cylindrical closer bore to said lower dead center than said first axial position;

a piston bore connecting said pressure space and said control valve bore through said piston at various axial positions of said piston;

said piston having a configuration to define an earliest and latest possible axial position of said piston at which injection will begin and said latest possible axial position is independent of said control valve for a given angular orientation of said piston; and means for controlling said control valve to select the axial position of said piston at which injection begins between said earliest and latest possible axial position of said piston at said given angular orientation.

4. A fuel injection pump according to claim 3, wherein said control valve is an electromagnetic valve.

5. A fuel injection pump according to claim 3, wherein said control valve includes a spring, biasing said control valve to a closed position.

6. A fuel injection pump according to claim 3, wherein said control valve is a normally closed valve.

7. A fuel injection pump according to claim 3, including an injection valve means between said pressure space and said injection port opening as a function of pressure in said pressure space.

8. A fuel injection pump according to claim 3, wherein said control valve is connected between said control valve bore and said fuel supply.

* * * * *